US007775256B2

(12) United States Patent
Kim

(10) Patent No.: US 7,775,256 B2
(45) Date of Patent: Aug. 17, 2010

(54) CURVED BRACE EDGE CONNECTION FITTING OF WINDOW

(76) Inventor: Jung Ryoul Kim, #294-21, Sindang 4-dong, Jung-gu, Seoul (KR) 100-454

( * ) Notice: Subject to any disclaimer, the term of this patent is extended or adjusted under 35 U.S.C. 154(b) by 548 days.

(21) Appl. No.: 11/573,805

(22) PCT Filed: Aug. 30, 2005

(86) PCT No.: PCT/KR2005/002867

§ 371 (c)(1),
(2), (4) Date: Feb. 16, 2007

(87) PCT Pub. No.: WO2006/025685

PCT Pub. Date: Mar. 9, 2006

(65) Prior Publication Data

US 2007/0295461 A1 Dec. 27, 2007

(30) Foreign Application Priority Data

Aug. 31, 2004 (KR) ..... 20-2004-0024860 U

(51) Int. Cl.
*E06B 9/00* (2006.01)

(52) U.S. Cl. ..... 160/381; 160/91; 160/100; 52/202

(58) Field of Classification Search ..... 49/246–248, 49/252, 501, 394; 160/381
See application file for complete search history.

(56) References Cited

U.S. PATENT DOCUMENTS 3,087,537 A * 4/1963 Le Van ..... 160/91
3,555,736 A * 1/1971 Koch, Jr. et al. ..... 49/504
3,808,742 A * 5/1974 Ehret et al. ..... 49/413
3,868,789 A * 3/1975 Gates ..... 49/501
3,942,286 A * 3/1976 Ehret et al. ..... 49/141
4,042,004 A * 8/1977 Kwan ..... 160/91
4,233,781 A * 11/1980 Roe ..... 49/504
5,421,125 A * 6/1995 Camp et al. ..... 49/404
5,431,211 A * 7/1995 Guillemet ..... 160/381
5,737,893 A * 4/1998 Rossiter et al. ..... 52/481.2
5,787,657 A * 8/1998 Librande et al. ..... 52/202
6,116,321 A * 9/2000 Kavchar ..... 160/100
6,170,555 B1 * 1/2001 Welfonder ..... 160/381
7,082,736 B2 * 8/2006 Farrar et al. ..... 52/741.1
7,568,316 B2 * 8/2009 Choby et al. ..... 52/203
2003/0127201 A1 * 7/2003 Perich et al. ..... 160/381

* cited by examiner

*Primary Examiner*—Richard E Chilcot, Jr.
*Assistant Examiner*—Alp Akbasli
(74) *Attorney, Agent, or Firm*—Ladas & Parry LLP

(57) ABSTRACT

A curved brace edge connection fitting and a curved brace window sash edge connection fitting and a window structure are provided. A coupling intensity of existing modular edge connection fittings can be heightened to simultaneously enhance air-tightness and heat insulation and to further provide effects of curved design and easy cleaning. The curved brace window frame edge connection fitting and the curved brace window sash edge connection fitting are used in a push-to-open window called a slider and a rotate-to-open window called a casement.

4 Claims, 8 Drawing Sheets

CURVED BRACE EDGE CONNECTION FITTING OF WINDOW

TECHNICAL FIELD

The present invention relates to a modular edge connection fitting which is used for a modular window frame and window pair and a window structure using the same, and more particularly to, a curved brace edge connection fitting and a curved brace window sash edge connection fitting corresponding to the curved brace edge connection fitting and a window structure using the same, to thereby enhance a coupling intensity of existing modular edge connection fittings to simultaneously enhance air-tightness and heat insulation and to thus provide effects of curved design and easy cleaning.

BACKGROUND ART

An existing window frame edge connection fitting which is widely used is shown in FIG. 1.

FIG. 1 shows part of an edge portion at one side of a window frame. For convenience of understanding, a horizontal bar 2 and a vertical bar 3 which are somewhat complicated are simply represented in sectional shape. Protrusions 10 are inserted into the horizontal bar 2 and the vertical bar 3, respectively, in order to firmly couple an edge connection fitting with the horizontal bar 2 and the vertical bar 3, when the edge connection fitting is fitted with the horizontal bar 2 and the vertical bar 3. A rubber packing 12 is interposed between each of the horizontal bar 2 and the vertical bar 3 and the edge connection fitting 5, in order to enhance air-tightness, respectively. On the upper portion of the horizontal bar 2 are formed a raised step 6, a groove 13 and a packing insertion groove (not shown) in lengthy direction. Likewise, on the upper portion of the vertical bar 3 are formed a raised step 6, a groove 13 and a packing insertion groove (not shown) in lengthy direction. In assembly, a worker fits the cut end portions of the horizontal bar 2 and the vertical bar 3 with the edge connection fitting 5 and then makes holes such as piece holes or screw holes into the edge connection fitting 5 by using a drilling machine, to then tighten pieces or screws 8 into the piece holes or screw holes. In FIG. 1, a reference numeral 7 denotes a piece hole or screw hole.

FIG. 2 shows a coupled state of FIG. 1, in which the horizontal bar 2 and the vertical bar 3 are coupled with the edge connection fitting 5 according to the conventional art. A window frame is classified into a convex type and a concave type according to the shape of the window frame with which a window sash is fitted. FIG. 2 shows a convex type window frame. A window sash is slid on the raised step 6. A concave type window frame is fabricated in the same shape and fabrication method as that of the convex type window frame, although it is not shown in the drawings. FIG. 2 shows positions of the raised step 6, the groove 13, and the screw hole 7.

FIG. 3 is a perspective view showing a coupling relationship of a conventional window sash edge connection fitting 5*a*. A glass groove 17*a* is formed in the inner circumference of the window sash edge connection fitting 5*a*, and a packing insertion groove 11*a* is formed in the lower portion of the glass groove 17*a*. The window sash edge connection fitting 5*a* is coupled in the same pattern as that of the window frame edge connection fitting 5. That is, protrusion 10*a* of the window sash edge connection fitting 5*a* are fitted into a horizontal bar 2*a* and a vertical bar 3*a*, respectively, and tightened by screws 8*a* to then be assembled with the horizontal bar 2*a* and the vertical bar 3*a*.

In FIGS. 2 and 3, the window frame edge connection fitting 5 and the window sash edge connection fitting 5*a* provide a coupling function which fits horizontal bars 2 and 2*a* and vertical bars 3 and 3*a*, respectively. Since the edge connection fittings 5 and 5*a* where the horizontal bars 2 and 2*a* and vertical bars 3 and 3*a* are crossed are coupled perpendicularly, the coupled modular window frame is weak with respect to a diagonally lateral compression force. Thus, in the case of windows at the windy seaside areas, high buildings, or seismal places, stronger connection fittings are required.

Also, the window frame edge connection fitting 5 and the window sash edge connection fitting 5*a* have no proper structures of packing insertion grooves 11*a* of FIGS. 2 and 3 into which packing members such as mohair called wind-proof hair (not shown) and gaskets made of soft rubber can be inserted.

That is, the horizontal bars 2 and 2*a* and vertical bars 3 and 3*a* are crossed are coupled perpendicularly, at the edge connection fittings 5 and 5*a*. Accordingly, packing members cannot be inserted into packing insertion grooves. Thus, the packing members are cut and used according to the lengths of the horizontal bars 2 and 2*a*, respectively. In the case of the vertical bars 3 and 3*a*, the packing members are also cut and used according to the lengths thereof. The packing members such as mohair called wind-proof hair (not shown) and gaskets made of soft rubber which are inserted into the horizontal bars 2 and 2*a* and vertical bars 3 and 3*a* are cut and used in proper lengths according to a skillfulness of a worker who performs a window assembly, and are fitted into the packing insertion grooves 11*a*. No matter how a worker is skill, he or she cuts packing members such as mohair called wind-proof hair (not shown) and gaskets made of soft rubber by eye measure in order to heighten a working speed, when the packing members are fitted into the packing insertion grooves 11*a* formed in the horizontal bars 2 and 2*a* and vertical bars 3 and 3*a*. As a result, the packing members may be cut shortly in comparison with the lengths of the horizontal bars 2 and 2*a* and vertical bars 3 and 3*a*, and thus it is difficult to insert the packing members such as mohair called wind-proof hair (not shown) and gaskets made of soft rubber which have been cut in proper lengths into the packing insertion grooves 11*a* formed in the horizontal bars 2 and 2*a* and vertical bars 3 and 3*a*. The packing members having been inserted into the packing insertion grooves formed in the horizontal bars 2 and 2*a* and vertical bars 3 and 3*a* reduce heat insulation and air-tightness, to thereby lower an energy efficiency and generate noise. Also, it is not so easy to clean dust collected in the perpendicular edges.

FIG. 13 is a perspective view of a typical casement which is one of casements. FIG. 14 is a perspective view of a tilt which is one of casements. FIG. 15 is a lateral cross-sectional view of a project which is one of casements. An edge connection fitting for a modular casement is not much developed in comparison with that of a slider. However, in the case of a slider which is opened in the form of protruding inwards or outwards in view of structure of a window, edge portions of a window sash 1*a* have a sharp point, respectively. This, if an article or person collides with the pointed edges due to carelessness, the article may be broken or the head or face of the person may be damaged severely. The protruded edge portions of synthetic resin window, wooden window, and hybrid window are always dangerous. In particular, since the edge portions of an aluminum window are sharp like a knife blade, an article or the head or face of person colliding with the pointed edges due to carelessness may be broken or damaged severely. Such an accident frequently takes place.

DISCLOSURE OF THE INVENTION

To solve the above problems, it is an object of the present invention to provide a curved brace window frame edge connection fitting which enhances a coupling intensity in which a brace playing a role of a brace in the window is formed as a window frame edge connection fitting located in an angular edge of the window frame in a window structure which is installed in an angular opening portion and employing a modular window frame.

It is another object of the present invention to provide a curved brace window sash edge connection fitting corresponding to a curved brace window frame edge connection fitting, which enhances a coupling intensity between the curved brace paired edge connection fitting and a curved brace window frame edge connection fitting, and which provides effects of air-tightness, heat insulation, soundproofing, safety from collision during opening and closing, and easy cleaning in which a packing insertion groove is curvedly formed along the curved window sash edge connection fitting and a packing member is inserted into the packing insertion groove.

It is still another object of the present invention to provide a window structure employing a curved brace window frame edge' connection fitting and/or a curved brace window sash edge connection fitting.

It is a further object of the present invention to provide a window structure including glass, in which glass is directly fitted into a window frame edge connection fitting or window sash edge connection fitting.

To accomplish the above object of the present invention, according to an aspect of the present invention, there is provided a curved brace window frame edge connection fitting for use in a window structure which is installed in an angular opening portion of an architecture building and is formed of a modular window frame, in which the window frame edge connection fitting is positioned at the angular edge of the window frame, characterized in that the window frame edge connection fitting comprises a brace formed in an edge on the inner circumference of the window frame edge connection fitting, wherein the brace is curved, and the outer circumference of the window frame edge connection fitting is angularly formed so as to be congruous with the angular edge of the angular opening portion.

Also, there is provided a curved brace window sash edge connection fitting for use in a window structure which is installed in an angular opening portion of an architecture building and is formed of a modular set of a window frame and a window sash coupled with the window frame, in which the window sash edge connection fitting is positioned at the edge of the window sash, characterized in that the window sash edge connection fitting is curved so that the outer circumference of the window sash edge connection fitting is congruous with the inner circumference of a curved brace in a window frame edge connection fitting in correspondence to the curved brace window frame edge connection fitting of claim 1, and a curved packing insertion groove is formed on the outer circumference of the window sash edge connection fitting.

Also, there is provided a window structure which is installed in an angular opening portion of an architecture building, the window structure comprising: a modular window frame including a curved brace edge connection fitting of claim 1; and glass which is fitted into the window frame, wherein the glass is fitted in a glass groove formed in the inner circumference of the window frame including the curved brace window frame edge connection fitting, and the glass groove formed in the inner circumference of the window frame including the curved brace window frame edge connection fitting is angularly formed along an angle formed by the outer circumference of the window frame edge connection fitting.

Also, there is provided a window structure which is installed in an angular opening portion of an architecture building, the window structure comprising: a modular window frame including a curved brace edge connection fitting of claim 1; and a modular window sash which is coupled with the window frame to allow an angular opening portion to be opened and closed, including a curved brace window sash edge connection fitting of claim 2, wherein a packing insertion groove of the curved window sash edge connection fitting is successively extended and formed on the outer circumference of the window sash.

Here, the window structure is a glass window structure including glass fitted into the window sash, the inner circumference of the curved brace window sash edge connection fitting in the window sash is formed of a curved plane of the same curvature as that of the outer circumference thereof, and the glass is fitted in a glass groove formed in the inner circumference of the window sash including the curved brace window sash edge connection fitting, and the glass groove formed in the inner circumference of the window sash including the curved brace window sash edge connection fitting is angularly formed along an angle formed by the outer circumference of the curved brace window sash edge connection fitting.

BRIEF DESCRIPTION OF THE DRAWINGS

The above and other objects and advantages of the present invention will become more apparent by describing the preferred embodiment thereof in detail with reference to the accompanying drawings in which.

BEST MODE FOR CARRYING OUT THE INVENTION

Hereinbelow, a curved brace edge connection fitting and a window structure using the same according to the present invention will be described with reference to the accompanying drawings.

Figure 4:
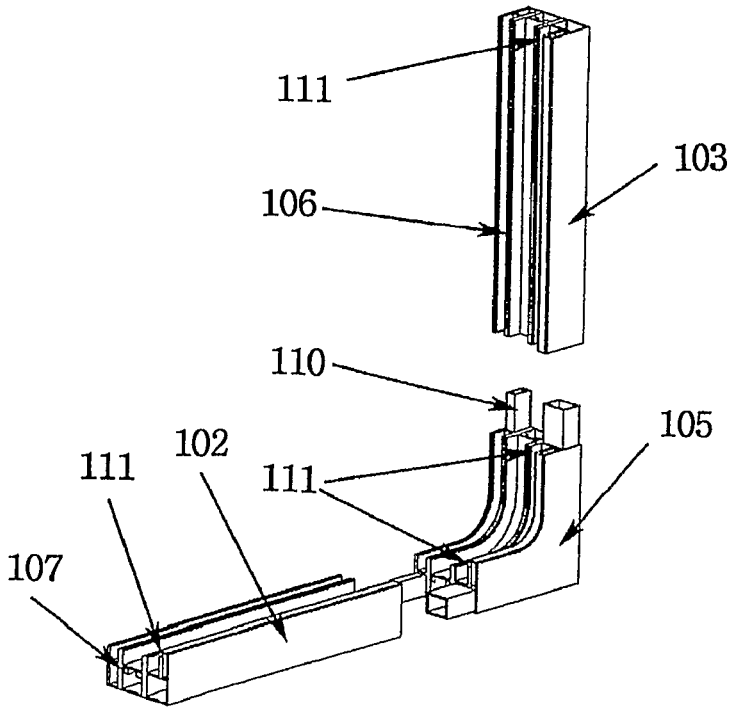
FIG. 4 is a perspective view showing part of a curved brace window frame edge connection fitting which is used for a slider according to an embodiment of the present invention.
Figure 5:
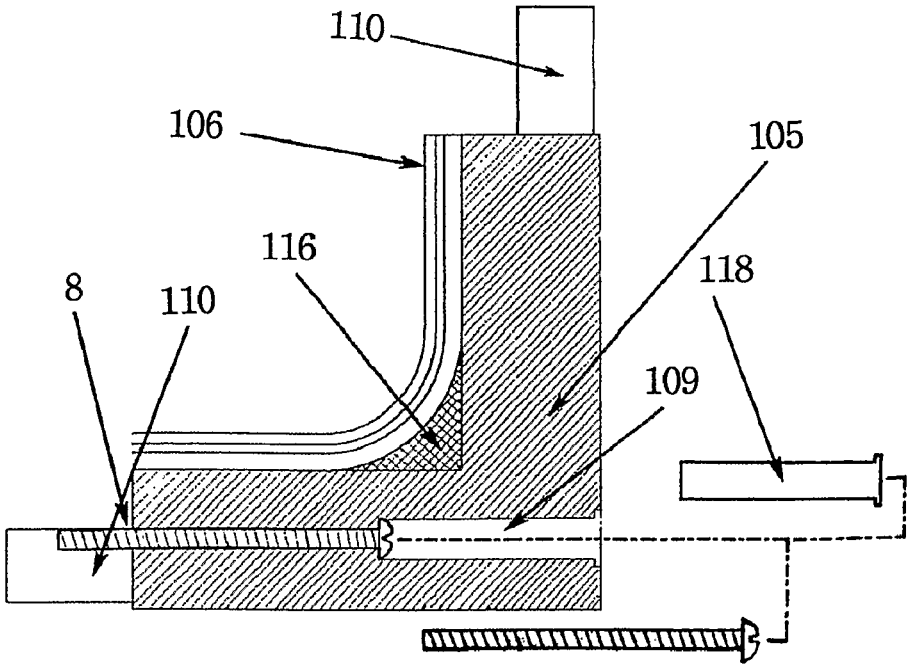
FIG. 5 is a cross-sectional view showing a curved brace window frame edge connection fitting which is used for a slider according to an embodiment of the present invention.

FIG. 4 is a perspective view showing a coupling relationship of a curved brace window frame edge connection fitting which is used for a slider according to an embodiment of the present invention. FIG. 5 is a laterally cross-sectional view showing a curved brace window frame edge connection fitting which is used for a slider according to an embodiment of the present invention.

Figure 1:
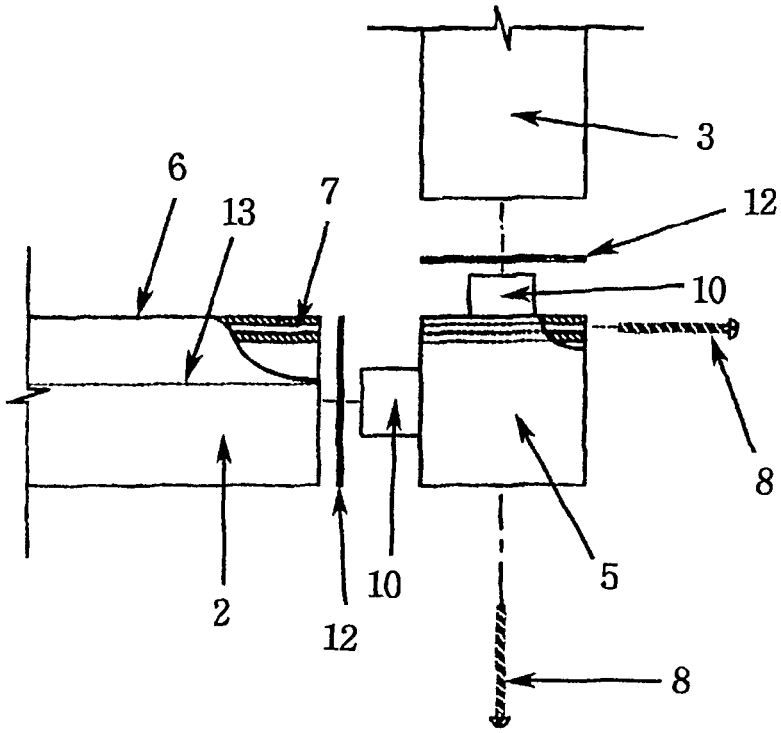
FIG. 1 is a front view showing a coupling relationship of only part of an edge portion in a conventional window frame edge connection fitting.
Figure 2:
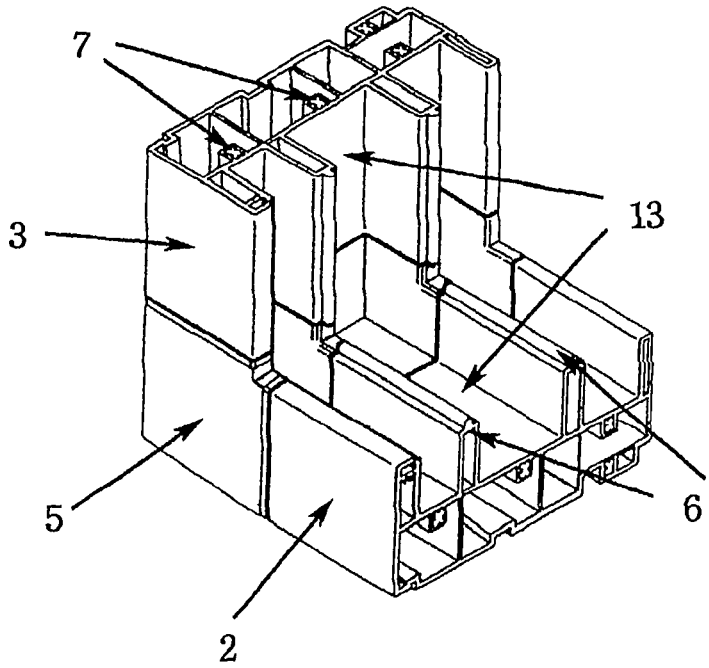
FIG. 2 is a perspective view of the coupled edge portion of FIG. 1.
Figure 3:
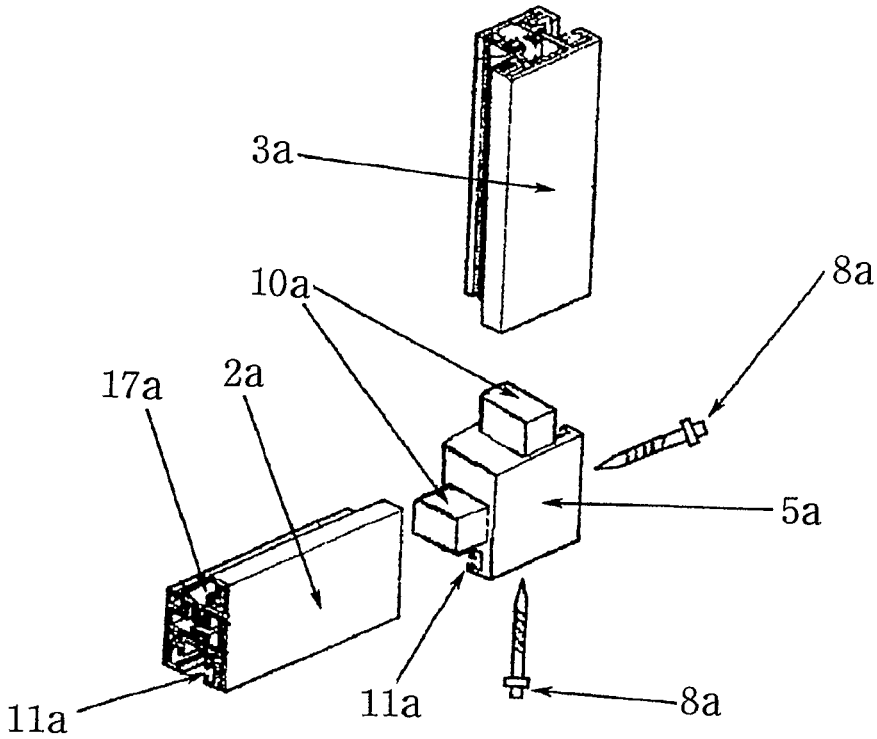
FIG. 3 is a perspective view showing a conventional window sash edge connection fitting.

Referring to FIGS. 4 and 5, a brace 116 which does not exist in the conventional window frame edge connection fitting 5 of FIG. 1 is formed in a curved brace window frame edge connection fitting 105. The brace 116 plays a role of preventing distortion and contortion of the window frame so that the frame is not deformed due to a compression force or tension applied to the window frame structure, and uniformly dispersing wind, pressure and vibration applied to the window frame structure to a horizontal bar 102 and a vertical bar 103, as well.

A portion playing a role of the brace 116 can be formed as a linear portion of a triangle. However, the brace 116 can be preferably curved as shown in FIG. 5. If the brace 116 is curved, additional effects such as a design effect of esthetic appreciation, an easy cleaning, and safety due to a curved surface can be obtained.

The inner circumference of the curved brace window frame edge connection fitting 105 has a structure that a raised step 106, a groove (not shown), and a packing insertion groove 111 having the same shapes as those of the raised step 106, the groove (not shown), and the packing insertion groove 111 formed in each of the horizontal bar 102 and the vertical bar 103 are curved. The edge portion in the conventional art is formed perpendicularly, to thus cause a difficult cleaning. However, since the inner circumference of the curved brace window frame structure edge connection fitting 105 is curved, an effect of an easy cleaning can be obtained. Also, a packing member (not shown) such as mohair of wind-proof hair and gasket of soft rubber is inserted into the packing insertion groove 111 at a time without cutting the packing member, and possibly fitted by turning, to thereby enhance heat insulation, air-tightness, and soundproof.

The outer circumference of the curved brace window frame edge connection fitting 105 is planar and perpendicular and differs from the inner circumference thereof of the curved shape. The reason why the outer circumference of the curved brace window frame edge connection fitting 105 is due to the fact that an opening portion of an architecture building where a window is installed is formed of a rectangular or square shape. That is, for a working convenience, only the inner circumference of the window frame edge connection fitting is curved.

In FIG. 5, a curved brace 116 is formed in the curved brace window frame edge connection fitting 105, and a screw 8 engaged with the horizontal bar 102 passes through a screw hole 109 of the curved brace window frame edge connection fitting 105 and protrudes. Likewise, although it is not shown in FIG. 5, a screw engaged with the vertical bar 103 passes through a screw hole of the curved brace window frame edge connection fitting 105 and protrudes in the case of a vertical axis (not shown). In coupling, protrusions 110 are inserted into the horizontal bar 102 and the vertical bar 103, and then screws 8 having passed through the screw holes 109 are assembled into screw grooves 107 formed in the horizontal bar 102 and the vertical bar 103. This is the same as that of the conventional art. As the length of the edge connection fitting gets longer, the screws 8 have been engaged into the screw grooves 107, and then part of the space in the screw holes 109 can be filled with a cover 118 made of the same material as that of the fabricated window frame.

Figure 6:
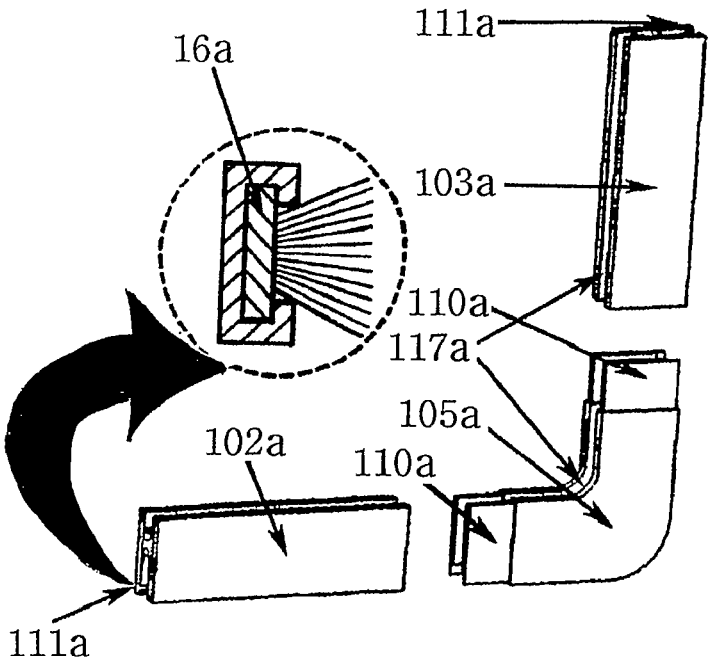
FIG. 6 is a perspective view showing a coupling relationship of part of a curved brace window sash edge connection fitting which is used for a slider according to an embodiment of the present invention.

FIG. 6 is a perspective view showing a coupling relationship of part of a curved brace window sash edge connection fitting 105*a* which is used for a slider according to an embodiment of the present invention.

A raised step 106*a* on the inner circumference of the curved brace window sash edge connection fitting 105*a* is curved. In particular, a glass groove 117*a* into which glass is fitted is perpendicularly formed so that glass can be conveniently cut. If a curved glass groove is extended up to the portion of the glass groove 117*a* of the curved brace window sash edge connection fitting 105*a*, glass is curvedly cut. Thus, a working time is delayed and a manpower cost increases. Accordingly, the glass groove is perpendicularly formed so that glass can be swiftly cut and inserted into the glass groove.

The outer circumference of the curved brace paired edge connection fitting 105*a* is formed of a curved plane corresponding to the curved brace window frame edge connection fitting. Screw holes (not shown) are formed as in the curved brace window frame edge connection fitting. Here, protrusions 110*a* are fitted into the horizontal bar 102*a* and the vertical bar 103*a*, and then are assembled with screws. This is the same as that of the conventional art. Also, packing insertion grooves 111*a* formed in the horizontal bar 102*a* and the vertical bar 103*a* are formed in a curved structure on the outer circumference of the curved brace paired edge connection fitting 105*a*. Accordingly, a window sash can be fitted while turning without cutting the packing members such as mohair 16*a* called wind-proof hair (not shown) and gaskets made of soft rubber. As a result, a working time can be shortened and heat insulation, air-tightness, and soundproofing can be enhanced. The protrusions 110*a* protrude from the contact surfaces of the paired edge connection fitting 105*a*, and are formed in structures appropriate for sliders, respectively. That is, the protrusions 110*a* are inserted into the horizontal bar 102*a* and the vertical bar 103*a*, in order to make the horizontal bar 102*a* and the vertical bar 103*a* firmly coupled with the edge connection fitting 105*a*.

Figure 7:
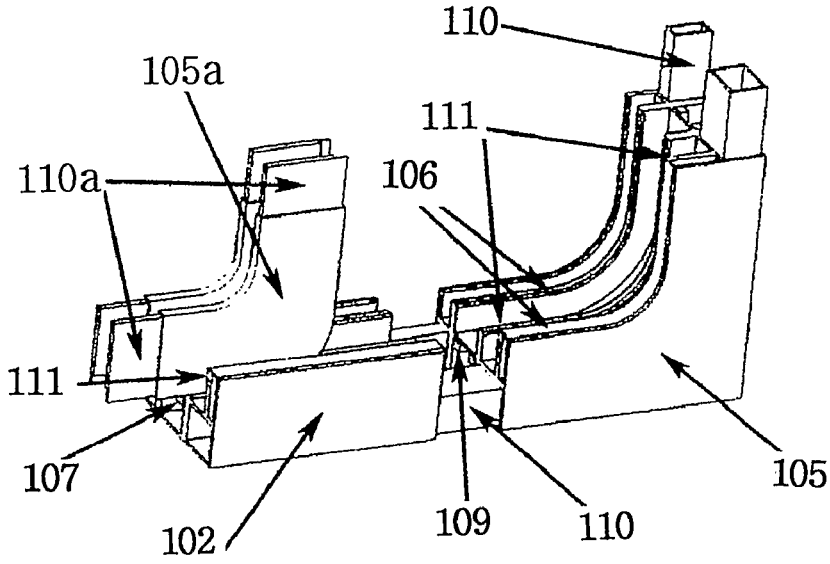
FIG. 7 is a perspective view showing a curved brace window sash edge connection fitting, a horizontal bar, and a curved brace window frame edge connection fitting, which are used for a slider according to an embodiment of the present invention.

FIG. 7 is a perspective view showing a curved brace window sash edge connection fitting, a horizontal bar, and a curved brace window frame edge connection fitting, which are used for a slider according to an embodiment of the present invention. In FIG. 7, it can be seen that the curved brace window sash edge connection fitting 105*a* slidingly moves through the horizontal bar 102 and a raised step 106 of the curved brace window frame edge connection fitting 105. Wheels (not shown) smoothing a sliding operation can be mounted on the outer circumference of the paired edge connection fitting. In FIG. 7, the same reference numerals as those of FIGS. 4 and 6 denote the same elements as those of FIGS. 4 and 6.

Figure 8:
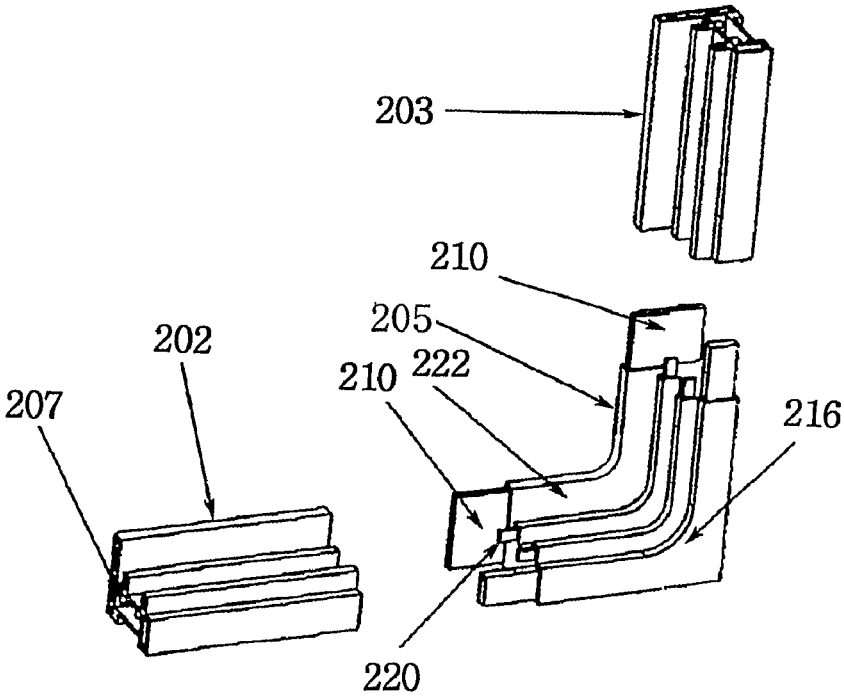
FIG. 8 is a perspective view showing part of a curved brace window frame edge connection fitting which is used for a casement according to an embodiment of the present invention.

FIG. 8 is a perspective view showing a coupling relationship of a curved brace window frame edge connection fitting which is used for a casement according to an embodiment of the present invention.

A stopper 222 is formed in a casement but is not formed in a slider. When a window sash is closed, the window sash contacts the stopper 222. That is, the stopper 222 absorbs impact occurring when the window sash is rotated, and is closely involved with heat insulation and air-tightness.

A curved brace 216 is formed in the casement in the same structure as that of the brace 116 used in the slider. The curved brace is a diagonal reinforcement member, which effectively disperses a pressure which is diagonally applied to the curved brace 216, to thus structurally stabilize the window frame of the casement.

The curved brace window frame edge connection fitting of the casement is curved in the same manner as those formed in the horizontal bar 202 and the vertical bar 203. Protrusions 210 are also formed in the curved brace window frame edge connection fitting 205, to thus firmly couple the horizontal bar 202 and the vertical bar 203, and auxiliary protrusions 220 are also formed therein to thus heighten accuracy of coupling. Since a coupling method of the curved brace window frame edge connection fitting 205 is same as that of the conventional art, the detailed description thereof will be omitted. A reference numeral 207 denotes a screw hole in FIG. 8.

Figure 9:
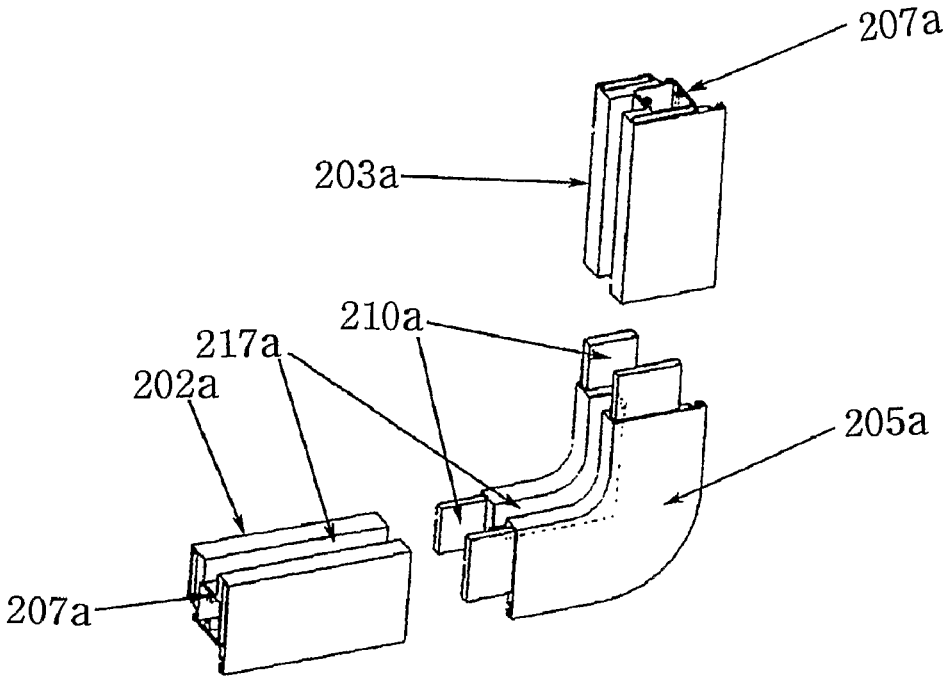
FIG. 9 is a perspective view showing a coupling relationship of part of a curved brace window sash edge connection fitting which is used for a casement according to an embodiment of the present invention, which is viewed from the front side.
Figure 10:
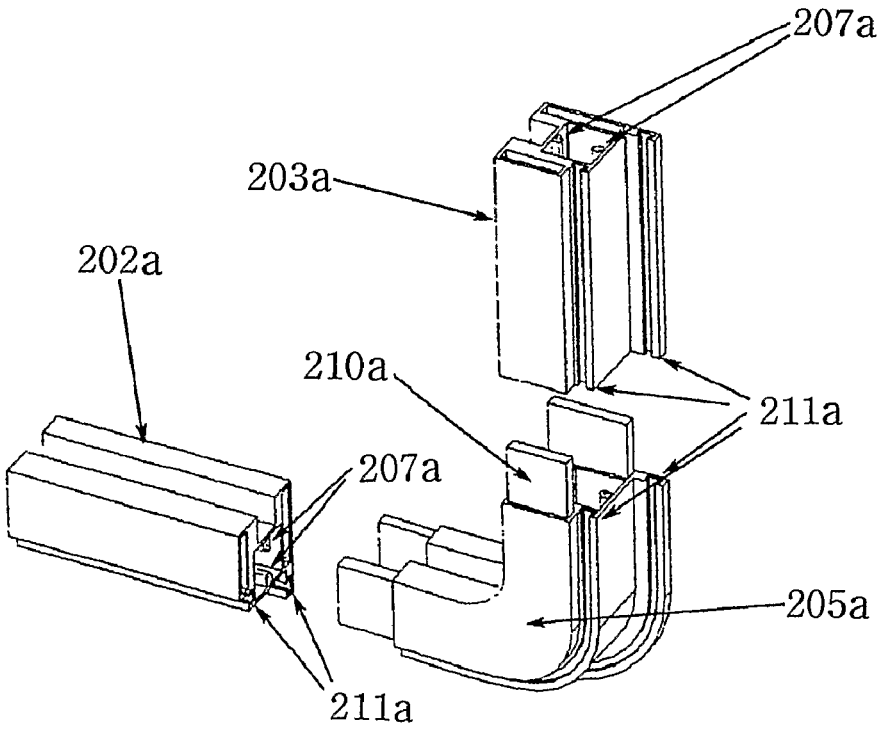
FIG. 10 is a perspective view showing a coupling relationship of part of a curved brace window sash edge connection fitting which is used for a casement according to an embodiment of the present invention, which is viewed from the rear side.

FIG. 9 is a perspective view showing a coupling relationship of part of a curved brace window sash edge connection fitting 205*a* which is used for a casement according to an embodiment of the present invention, which is viewed from the front side, and FIG. 10 is a perspective view which is viewed from the rear side in FIG. 9.

A raised step 206*a* on the inner circumference of the curved brace window sash edge connection fitting 205*a* is curved. In particular, a glass groove 217*a* into which glass is fitted is perpendicularly formed.

The outer circumference of the curved brace paired edge connection fitting 205*a* is formed of a curved plane corresponding to the curved brace window frame edge connection fitting 205. That is, the curved brace window sash edge connection fitting 205*a* should be of a curved structure so as to face the curvature radius of the curved brace window frame structure edge connection fitting 205.

As described above, the outer circumference of the curved brace paired edge connection fitting 205*a* is formed of a curved plane, and screw holes (not shown) are formed in the outer circumference of the curved brace window sash edge connection fitting 205*a*, as spaces into which screws are fitted. The screw holes (not shown) are formed in the same manner as that of FIG. 5 which is a cross-sectional view of the window frame edge connection fitting 105. The curved brace window sash structure edge connection fitting 205*a* has a structure that a raised step 206*a*, a glass groove (not shown), and a packing insertion groove 114 having the same shapes as those of the raised steps 206*a*, the glass grooves 217*a*, and the packing insertion grooves 211*a* formed in the horizontal bar 202*a* and the vertical bar 203*a* are curved. Differently from the window sash of a slider, the curved brace window sash edge connection fitting of a casement bringing a stopper into contact has a structure that packing insertion grooves are formed in one direction and thus the window is rotated by means of a hinge or a hinge arm so as to be opened and closed. The window sash also performs such a rotational function to bring a stopper of a window frame into contact so that the window sash is closed.

Referring to FIG. 10, a packing member (not shown) fitted into the a packing insertion groove of the vertical bar are fitted into packing insertion grooves of the horizontal bar along the packing insertion grooves of the curved edge connection fitting, and then fitted with the curved edge connection fitting again. Then, the packing members (not shown) are fitted into the vertical bar, the curved edge connection fitting, the horizontal bar, and the curved edge connection fitting, to then be fitted into the vertical bar which has been inserted initially. A window sash coupling method is same as that of the conventional assembly method, and has been described above. Accordingly, the detailed description thereof will be omitted. A reference numeral 211*a* denotes a packing member.

Figure 11:
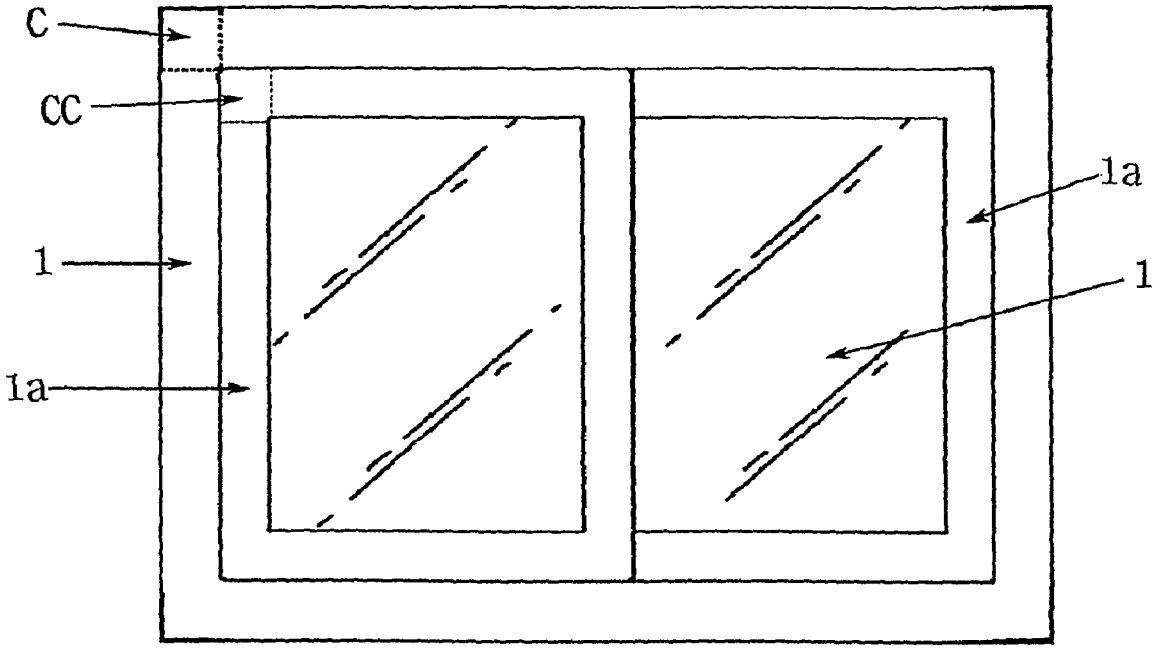
FIG. 11 is a front view of a slider.

FIG. 11 is a front view of a slider. A window sash 1*a* moves to the left or right along a guide groove (not shown) such as a rail formed in a window frame 1. The slider includes one window frame and two window sashes. Although only one of edge portions is indicated in dotted lines at one corner in FIG. 11, a portion "C" in each of the four window frame edge connection fittings can be replaced by the curved brace window frame edge connection fitting 105 of FIG. 4 according to an embodiment of the present invention. A portion "CC" can be fabricated into two window frames using eight paired edge connection fittings in two window sashes since the number of window sashes is two (2), and can be replaced by a curved brace window sash connection fitting 105*a* of FIG. 6 according to an embodiment of the present invention.

Figure 12:
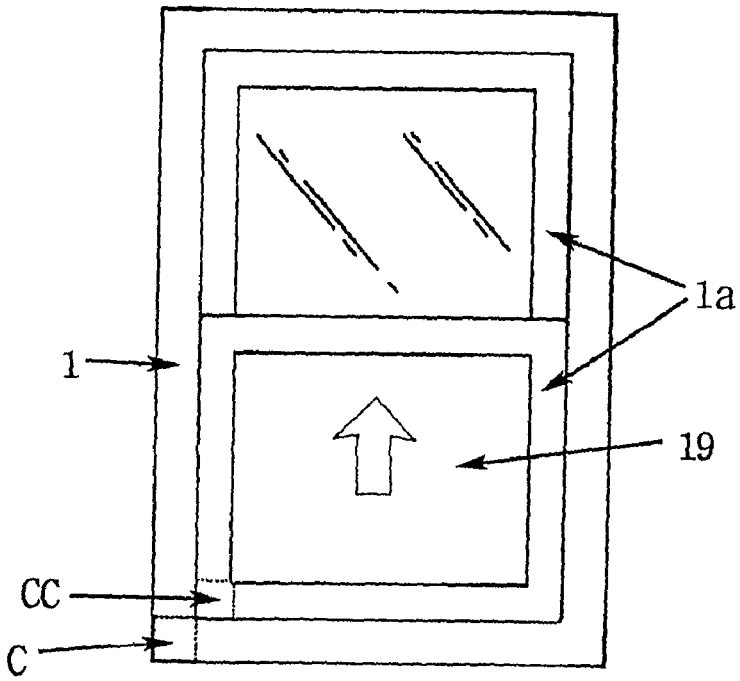
FIG. 12 is a front view of a single-hung.

FIG. 12 is a front view of a single-hung. A window sash 1*a* moves to the left or right along a guide groove (not shown) such as a rail formed in a window frame 1. The slider includes one window frame and two window sashes. Although only one of edge portions is indicated in dotted lines at one corner in FIG. 12, a portion "C" in four window frame edge connection fittings can be replaced by a curved brace window frame structure edge connection fitting 105 according to an embodiment of the present invention. A portion "CC" can be also replaced by a curved brace window sash connection fitting 105*a* according to an embodiment of the present invention. A reference numeral 19 denotes glass.

Figure 13:
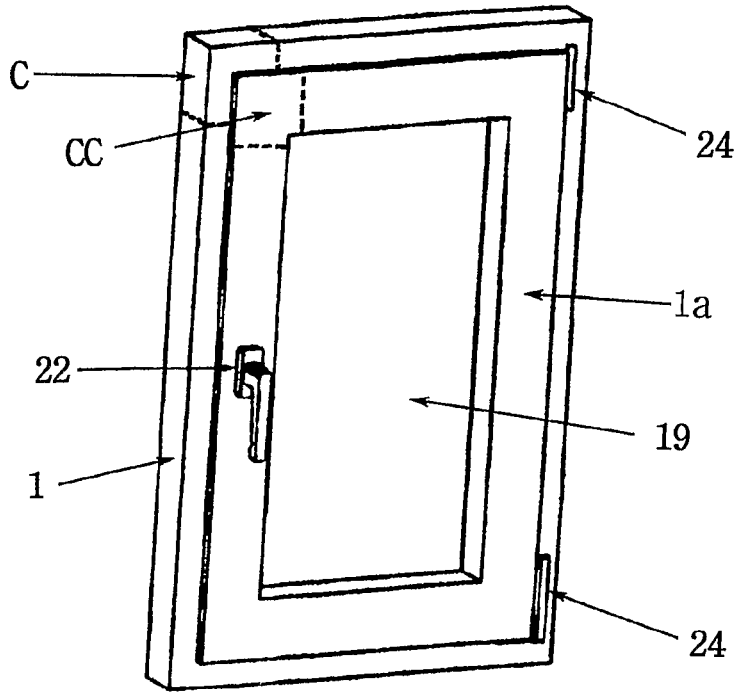
FIG. 13 is a perspective view of a casement which is one of casements.

FIG. 13 is a perspective view of a typical casement which is one of casements. Hinges 24 support a window sash 1*a* and adjusts a knob 22, so that the window sash 1*a* is opened or closed inwards or outwards. Although a portion "C" is indicated on only one corner, the window frame 1 can be assembled using four curved brace window frame edge connection fittings 205 according to the present invention. A portion "CC" is completed into an edge portion of a window sash using each of four curved brace window sash connection fittings 205*a* according to an embodiment of the present invention. A reference numeral 19 denotes glass.

Figure 14:
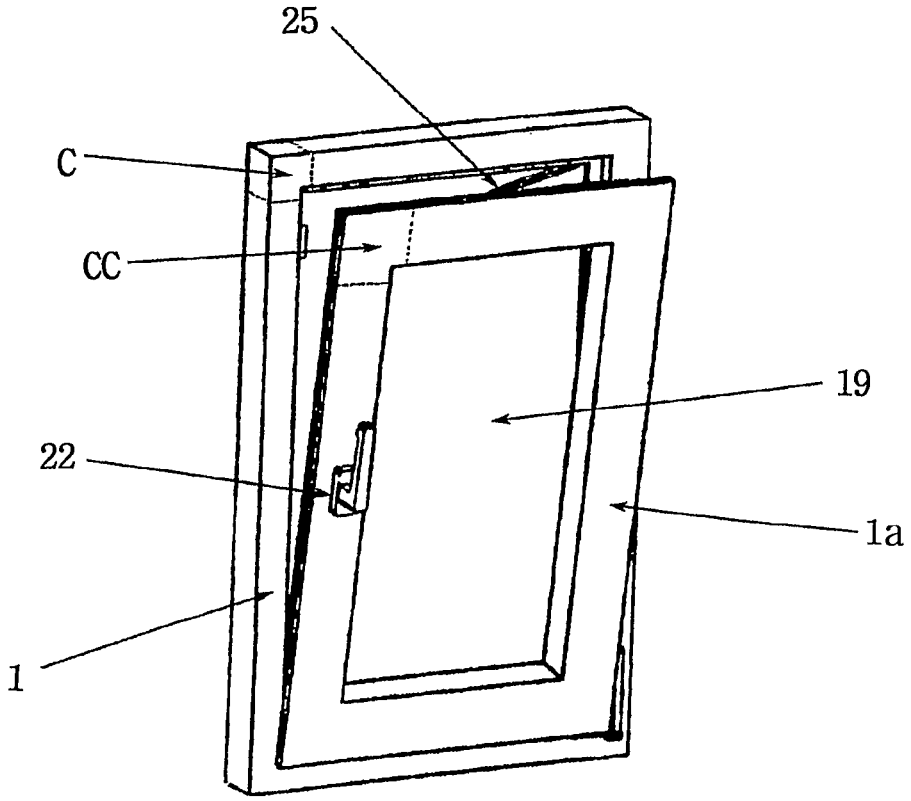
FIG. 14 is a perspective view of a tilt which is one of casements.

FIG. 14 is a perspective view of a tilt which is one of casements. A hinge arm 25 installed in a window frame 1 is coupled with a paired widow 1*a*. The tilt is a kind of a ventilation window so that the upper portion of the window sash 1*a* can be opened using a knob 22. Although a portion "C" is indicated on only one corner, the window frame 1 can be assembled using four curved brace window frame edge connection fittings 205 according to the present invention. A portion "CC" is completed into an edge portion of a window sash using each of four curved brace window sash connection fittings 205*a* according to an embodiment of the present invention. A reference numeral 19 denotes glass.

Figure 15:
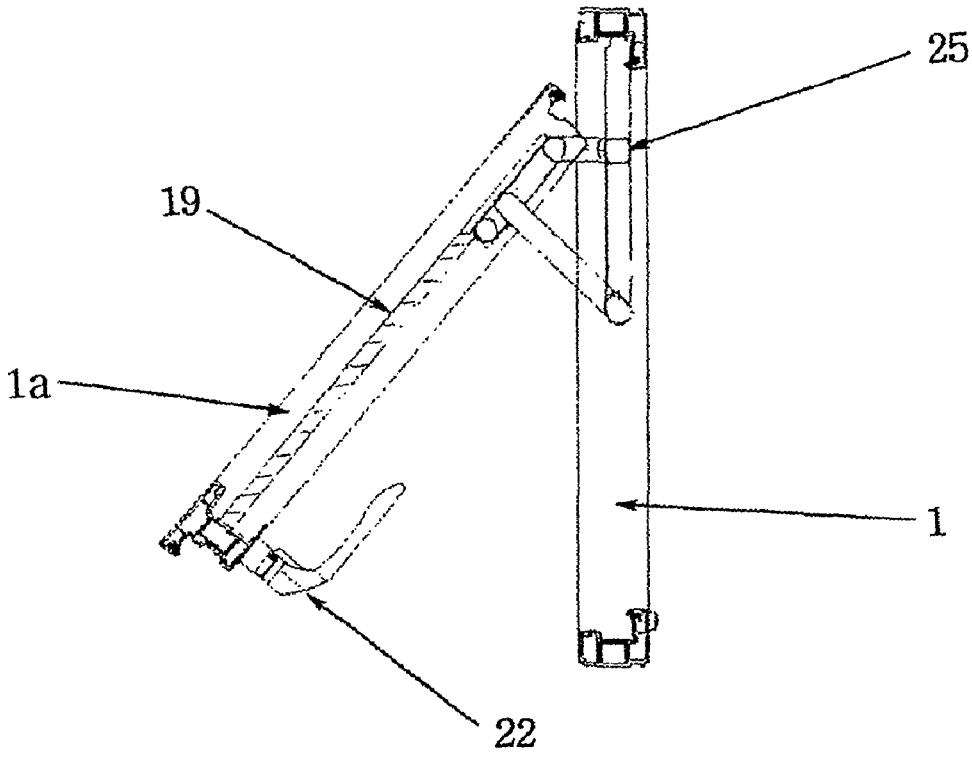
FIG. 15 is a lateral cross-sectional view of a project which is one of casements.

FIG. 15 is a lateral cross-sectional view of a project which is one of casements. A hinge arm 25 installed in a window frame 1 is coupled with a paired widow 1*a*. The project is rotated so as to be opened using a knob 22. In the case of the project, the window frame 1 can be assembled using four curved brace window frame edge connection fittings 205 according to the present invention. Also, an edge portion of the window sash can be completed using each of four curved brace window sash edge connection fittings 205*a* according to the present invention. A reference numeral 19 denotes glass.

Figure 16:
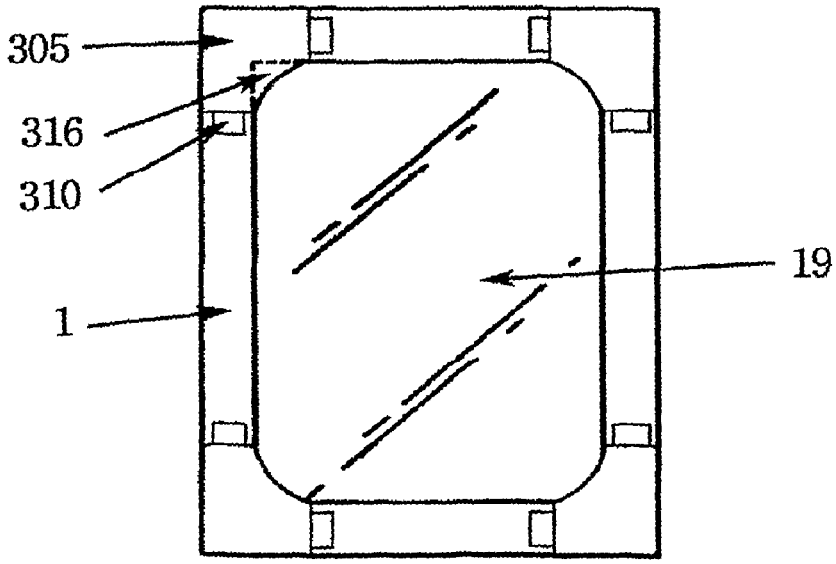
FIG. 16 is a perspective view of a fixed according to another embodiment of the present invention.

FIG. 16 is a perspective view of a fixed according to another embodiment of the present invention. A window sash is not used in the fix. A glass groove is formed in the window frame 1 so that glass 19 can be directly fitted. Although the glass groove is not shown in the drawing, it is formed at a right angle. The inner circumference of an edge connection fitting 305 excluding the glass groove is of a curved structure forming a brace 316, and the outer circumference thereof is formed at a right angle on a plane and protrusions 310 are formed in both sides of the fix. A reference numeral 19 denotes glass.

INDUSTRIAL APPLICABILITY

As described above, the present invention provides an aesthetic design effect using a curved brace window frame edge connection fitting and a curved brace window sash edge connection fitting, and other effects of easy cleaning and structural stability with respect to outer objects and persons which may happen to occur at the time of collision with a window sash edge since an edge connection fitting which was formed at a right angle is curved. Also, the present invention provides an effect of enhancing structural reinforcement with respect to an external pressure in coupling a window frame and window sashes, and effects of saving manpower and time and enhancing a productivity per hour in which packing insertion grooves into which packing members such as mohair or windproof hair, and gaskets of soft rubber formed in a horizontal bar and a vertical bar of the edge connection fitting are curved to thus have a window frame inserted one time and rotated so as to be fitted with a window sash. Also, the packing members which are inserted without having been cut provide an effect of enhancing functions of a window such as heat insulation, air-tightness, and soundproofing As described above, the present invention has been described with respect to a particularly preferred embodiment. However, the present invention is not limited to the above embodiment, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

What is claimed is:

1. A curved brace window sash edge connection fitting for use in a window structure which is installed in an angular opening portion of an architectural building and is formed of a modular set of a window frame and a window sash coupled with the window frame, in which the window sash edge connection fitting is positioned at the edge of the window sash, characterized in that the window sash edge connection fitting is curved so that the outer circumference of the window sash edge connection fitting is congruous with the inner circumference of a curved brace in a window frame edge connection fitting in correspondence to the curved brace window frame edge connection fitting, and a curved first packing insertion groove is formed on the outer circumference of the window sash edge connection fitting wherein the curved packing insertion groove is packed with a packing member, and the curved brace window frame edge connection fitting for use in the window structure which is installed in the angular opening portion of the architectural building and is formed of a modular window frame, in which the window frame edge connection fitting is positioned at the angular edge of the window frame, characterized in that the window frame edge connection fitting comprises a brace formed in an edge on the inner circumference of the window frame edge connection fitting, wherein the brace is curved, and the outer circumference of the window frame edge connection fitting is angularly formed so as to be congruous with the angular edge of the angular opening portion, and a curved second packing insertion groove is formed on the outer circumference of the window edge connection fitting wherein the second packing insertion groove is packed with a packing member.

2. A window structure which is installed in an angular opening portion of an architectural building, the window structure comprising:

a modular window frame including a curved brace edge connection fitting wherein the curved brace window frame edge connection fitting for use in the window structure which is installed in an angular opening portion of the architectural building and is formed of a modular window frame, in which the window frame edge connection fitting is positioned at the angular edge of the window frame; and glass which is fitted into the window frame, wherein the glass is fitted in a glass groove formed in the inner circumference of the window frame including the curved brace window frame edge connection fitting, and the glass groove formed in the inner circumference of the window frame including the curved brace window frame edge connection fitting is angularly formed along an angle formed by the outer circumference of the window frame edge connection fitting, characterized in that the window frame edge connection fitting comprises a brace formed in an edge on the inner circumference of the window frame edge connection fitting, wherein the brace is curved, and the outer circumference of the window frame edge connection fitting is angularly formed so as to be congruous with the angular edge of the angular opening portion, and a curved packing insertion groove is formed on the outer circumference of the window edge connection fitting wherein the groove is packed with a packing member.

3. A window structure which is installed in an angular opening portion of an architectural building, the window structure comprising:

a modular window frame including a curved brace edge connection fitting wherein the curved brace window frame edge connection fitting for use in the window structure which is installed in an angular opening portion of the architectural building and is formed of a modular window frame, in which the window frame edge connection fitting is positioned at the angular edge of the window frame, characterized in that the window frame edge connection fitting comprises a brace formed in an edge on the inner circumference of the window frame edge connection fitting, wherein the brace is curved, and the outer circumference of the window frame edge connection fitting is angularly formed so as to be congruous with the angular edge of the angular opening portion, and a curved first packing insertion groove is formed on the outer circumference of the window edge connection fitting wherein the first packing insertion groove is packed with a packing member; and a modular window sash which is coupled with the window frame to allow an angular opening portion to be opened and closed, including a curved brace window sash edge connection fitting, wherein the curved brace window sash edge connection fitting for use in the window structure which is installed in an angular opening portion of the architectural building and is formed of a modular set of a window frame and a window sash coupled with the window frame, in which the window sash edge connection fitting is positioned at the edge of the window sash, characterized in that the window sash edge connection fitting is curved so that the outer circumference of the window sash edge connection fitting is congruous with the inner circumference of a curved brace in a window frame edge connection fitting in correspondence to the curved brace window frame edge connection fitting, and a curved second packing insertion groove is formed on the outer circumference of the window sash edge connection fitting wherein the curved second packing insertion groove is packed with a packing member, and the curved brace window frame edge connection fitting for use in a window structure which is installed in an angular opening portion of an architectural building and is formed of a modular window frame, in which the window frame edge connection fitting is positioned at the angular edge of the window frame, wherein a packing insertion groove of the curved window sash edge connection fitting is extended and formed on the outer circumference of the window sash.

4. The window structure of claim 3, wherein the window structure is a glass window structure including glass fitted into the window sash, the inner circumference of the curved brace window sash edge connection fitting in the window sash is formed of a curved plane of the same curvature as that of the outer circumference thereof, and the glass is fitted in a glass groove formed in the inner circumference of the window sash including the curved brace window sash edge connection fitting, and the glass groove formed in the inner circumference of the window sash including the curved brace window sash edge connection fitting is angularly formed along an angle formed by the outer circumference of the curved brace window sash edge connection fitting.

* * * * *